US008981174B2

(12) United States Patent
Wines

(10) Patent No.: US 8,981,174 B2
(45) Date of Patent: Mar. 17, 2015

(54) METHODS AND SYSTEMS FOR PROCESSING CRUDE OIL USING CROSS-FLOW FILTRATION

(71) Applicant: Pall Corporation, Port Washington, NY (US)

(72) Inventor: Thomas Harris Wines, East Northport, NY (US)

(73) Assignee: Pall Corporation, Port Washington, NY (US)

( * ) Notice: Subject to any disclaimer, the term of this patent is extended or adjusted under 35 U.S.C. 154(b) by 0 days.

(21) Appl. No.: 13/873,913

(22) Filed: Apr. 30, 2013

(65) Prior Publication Data

US 2014/0323789 A1 Oct. 30, 2014

(51) Int. Cl.
*C10G 31/09* (2006.01)

(52) U.S. Cl.
CPC ..... *C10G 31/09* (2013.01)
USPC ..... 585/802; 208/390; 585/818

(58) Field of Classification Search
None
See application file for complete search history.

(56) References Cited

U.S. PATENT DOCUMENTS

| | | | | |
|---|---|---|---|---|
| 4,634,520 | A | 1/1987 | Angelov et al. | |
| 4,684,457 | A | 8/1987 | McKechnie et al. | |
| 5,219,471 | A | 6/1993 | Goyal et al. | |
| 5,868,939 | A | 2/1999 | Oder et al. | |
| 5,882,506 | A | 3/1999 | Ohsol et al. | |
| 5,976,366 | A | 11/1999 | Hwang et al. | |
| 7,497,954 | B2 | 3/2009 | Ivan et al. | |
| 2009/0152163 | A1 | 6/2009 | Goldman | |
| 2010/0089797 | A1 | 4/2010 | Chakka et al. | |
| 2010/0243534 | A1 | 9/2010 | Ng et al. | |
| 2010/0276375 | A1 | 11/2010 | Sams | |
| 2013/0104772 | A1 * | 5/2013 | Schabron et al. | 106/277 |
| 2013/0331632 | A1 * | 12/2013 | Drake | 585/802 |
| 2014/0034553 | A1 * | 2/2014 | Palmer et al. | 208/390 |

FOREIGN PATENT DOCUMENTS

| | | | |
|---|---|---|---|
| WO | WO 94/16033 | A1 | 7/1994 |
| WO | WO 2008/117005 | A1 | 10/2008 |
| WO | WO 2010/134822 | A1 | 11/2010 |

* cited by examiner

*Primary Examiner* — Tam M Nguyen
(74) *Attorney, Agent, or Firm* — Leydig, Voit & Mayer

(57) ABSTRACT

Methods and systems for processing crude oil comprise adding water to the crude oil to produce an emulsion comprising brine and oil and solids; separating oil from brine including producing brine comprising a rag layer; separating the rag layer into a hydrocarbon emulsion having finer solids and brine comprising larger solids; and passing the hydrocarbon emulsion along a cross-flow filter to produce a retentate comprising brine and solids and a permeate comprising hydrocarbon.

10 Claims, 4 Drawing Sheets

METHODS AND SYSTEMS FOR PROCESSING CRUDE OIL USING CROSS-FLOW FILTRATION

BACKGROUND OF THE INVENTION

During some crude oil refinery processes, an emulsion also known as a "rag layer" or "slop" may form. This rag layer may include any one or more of several substances, including, for example, oil and/or other hydrocarbons, brine, asphaltenes, and/or solids. The solids may include small solid particles of metal or grit as well as colloidal particles, and the rag layer may cause fouling and corrosion in refinery systems, which may disadvantageously reduce the efficiency and capacity of the refinery system.

Accordingly, there is a need for improved systems and methods for processing crude oil.

BRIEF SUMMARY OF THE INVENTION

An embodiment of the invention provides a method of processing crude oil comprising adding water to the crude oil to produce oil and brine and a rag layer including an emulsion comprising brine and oil and solids; separating oil from brine including producing brine comprising the rag layer, separating the rag layer into a hydrocarbon emulsion having finer solids and brine comprising larger solids; and passing the hydrocarbon emulsion and finer solids along a cross-flow filter to produce a retentate comprising brine and solids and a permeate comprising hydrocarbon.

Another embodiment of the invention provides a method of processing crude oil comprising passing the crude oil and water into a desalter, including separating oil from brine comprising a rag layer and removing the brine comprising a rag layer from the desalter via a first port and removing the oil via a second port; passing the brine comprising a rag layer through a separator including separating the rag layer into a hydrocarbon emulsion having finer solids and brine comprising larger solids, including removing the brine comprising larger solids from the separator via a third port and removing the hydrocarbon emulsion and finer solids from the separator via a fourth port; and filtering the hydrocarbon emulsion and finer solids using a cross-flow filter to produce a retentate comprising brine and solids and a permeate comprising hydrocarbon, including removing the retentate from the cross-flow filter via a fifth port and removing the permeate from the cross-flow filter via a sixth port.

Still another embodiment of the invention provides a system for processing crude oil, the system comprising a desalter that separates oil from brine comprising a rag layer; at least one port directing the oil from the desalter at least one port directing the brine comprising the rag layer from the desalter, a separator that separates the rag layer into a hydrocarbon emulsion having finer solids and brine comprising larger solids; at least one port directing the rag layer into the separator; at least one port directing the hydrocarbon emulsion and finer solids from the separator; at least one port directing the brine and larger solids from the separator, a housing including a cross-flow filter that separates the hydrocarbon emulsion and finer solids into a permeate comprising hydrocarbon and a retenate comprising brine and solids; at least one port directing permeate from the housing; at least one port directing retentate from the housing; and at least one port directing the hydrocarbon emulsion and finer solids into the housing.

The methods and systems of the invention provide many advantages. For example, the methods and systems of the invention advantageously reduce or eliminate fouling and/or corrosion in oil refinery systems by removing solids that would otherwise damage the components of the refinery system. Further, methods and systems of the invention allow the rag layer to be effectively and efficiently processed, recovering much of the hydrocarbon, including oil, that would otherwise be lost to the rag layer. Accordingly, the methods and systems of the invention may advantageously increase the reliability, efficiency, and capacity of oil refinery processes.

DETAILED DESCRIPTION OF THE INVENTION

Figure 1:
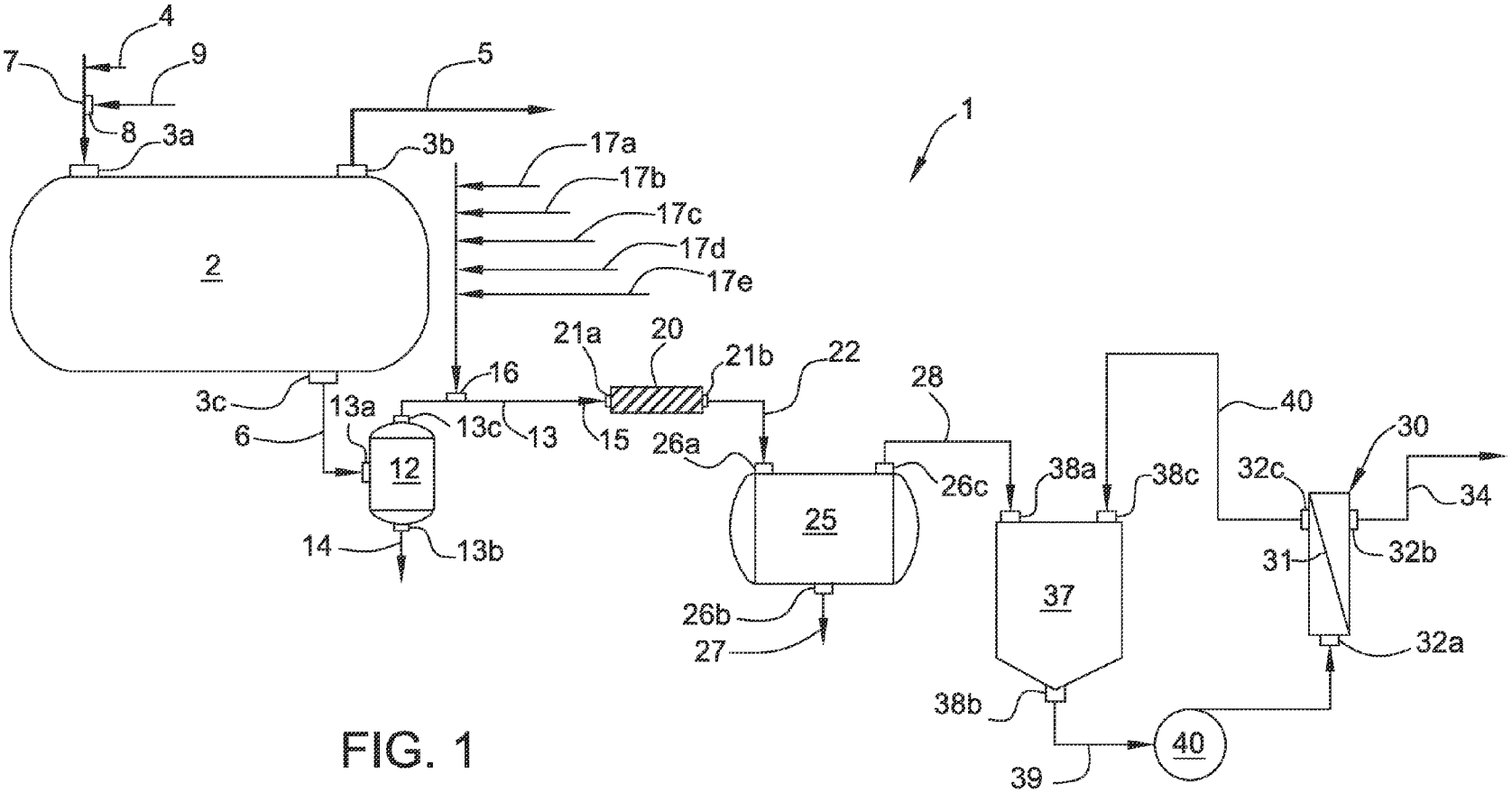
FIG. 1 is a representative schematic view, not to scale, of one embodiment of a system for processing crude oil.

Methods and systems for processing crude oil using cross-flow filtration may be configured in any of a wide variety of ways. One of the many different examples of a system for processing crude oil is shown in FIG. 1. The system may comprise, for example, a desalter; a bulk separator; at least one inlet port directing one or more of additional hydrocarbon, a demulsifier, a reverse demulsifier, a coagulant, and a flocculant into the rag layer; a mixer; a separator; a working tank; and a cross-flow filter.

The components of the system may be variously configured. For example, the desalter may be configured in any of a variety of different ways. The desalter may take any form and may have any shape, including, for example, that of a tank or receptacle. The desalter may remove metals and/or salts and other dissolvables from crude oil by combining crude oil and water to produce oil, brine, and a rag layer. Crude oil and water may be supplied to the desalter separately, or crude oil and water may be mixed together upstream of the desalter and the mixture may be supplied to the desalter. The desalter may also function as a coalescer, e.g., an electrostatic coalescer, and a separator. Within the desalter, the crude oil and the brine may separate from one another, and a rag layer comprising an emulsion including brine and oil and solids and other substances, such as asphaltenes, may form, for example, on top of the brine and/or at an interface between the oil and brine. The rag layer may also be entrained as droplets or masses, for example, within the brine.

The desalter may also include at least one port. In many embodiments, the desalter may include two or more ports. For example, as shown in FIG. 1, the desalter may include three ports 3*a*, 3*b*, and 3*c*. Any port may be positioned anywhere on the desalter, including the top, bottom, or sides of the desalter. More than one port may be positioned on the same side of the desalter or on different sides of the desalter. For example, as shown in FIG. 1, a port 3*a* may be positioned on the top of the desalter 2, a port 3*b* may be positioned on the top of the desalter 2, and a port 3*c* may be positioned on the bottom of the desalter 2.

The ports may include at least one inlet port directing crude oil (or a mixture of crude oil and water) into the desalter. The inlet port directing the crude oil (or mixture of crude oil and water) into the desalter may be positioned anywhere on the desalter. For example, as shown in FIG. 1, the inlet port 3*a* directing the crude oil (or mixture of crude oil and water) into the desalter may be positioned on the top of the desalter. The inlet port directing the crude oil (or mixture of crude oil and water) into the housing may fluidly communicate between the interior of the desalter and the interior of an external crude oil source (not shown). For example, as shown in FIG. 1, desalter 2 may include at least one inlet port 3*a* fluidly communicating between an exterior crude oil source and the interior of the desalter 2. Crude oil (or mixture of crude oil and water) may pass through the inlet port and enter the desalter from an external source as shown, e.g., by arrow 4.

In some embodiments, the system may further comprise a conduit directing crude oil into the desalter. The conduit directing crude oil into the desalter may fluidly communicate between the interior of the desalter and the interior of an external crude oil source. For example, as shown in FIG. 1, system 1 may include at least one conduit 7 directing crude oil into the desalter 2 fluidly communicating between an external crude oil source and the interior of the desalter via inlet port 3*a*. Although FIG. 1 shows the conduit in fluid communication with an inlet port 3*a* located at the top of the desalter, the conduit may be in fluid communication with an inlet port located anywhere on the desalter, including the top, bottom, or sides of the desalter. Crude oil may pass through the conduit directing crude oil into the desalter and enter the desalter from an external source as shown, e.g., by arrow 4.

In some embodiments, the system may comprise one or more water inlet ports for directing water into the desalter. For example, as shown in FIG. 1, the system may include one water inlet port 8. Although FIG. 1 shows one water inlet port 8, the system may comprise any number of ports directing water into the desalter. The water inlet port may be positioned anywhere on the system, for example, on the desalter or on the conduit directing crude oil into the desalter. The water inlet port may fluidly communicate between the interior of the conduit directing crude oil into the desalter or the desalter and an exterior water source (not shown). For example, as shown in FIG. 1, system 1 may include at least one water inlet port 8 fluidly communicating between an external water source and the interior of the conduit 7 directing crude oil into the desalter 2. Water may pass through the water inlet port and enter the conduit directing crude oil into the desalter from an external source as shown, e.g., by arrow 9. Although FIG. 1 shows the water inlet port 8 positioned on the conduit 7 directing crude oil into the desalter, the water inlet port may, additionally or alternatively, be positioned anywhere on the desalter itself. Accordingly, the water may pass through the water inlet port positioned on the desalter and directly enter the desalter from an external source.

Various other chemicals, including, for example, demulsifiers and/or corrosion inhibitors, may be supplied to the desalter, e.g., via additional inlet ports or a common inlet port. Further, a heater (not shown) may be associated with the desalter or the sources of crude oil and water to heat the crude oil and water supplied to the desalter. The heater may be variously configured, for example, as a heat exchanger or a steam injector.

The ports of the desalter may include at least one outlet port directing desalted oil from the desalter. The outlet port directing desalted oil from the desalter may be positioned anywhere on the desalter in fluid communication with the desalted oil within the desalter. For example, as shown in FIG. 1, the outlet port 3*b* directing desalted oil from the desalter may be positioned on the top of the desalter. The outlet port directing desalted oil from the desalter may fluidly communicate between the interior of the desalter and the exterior of the desalter. For example, as shown in FIG. 1, desalter 2 may include at least one outlet port 3*b* fluidly communicating between the interior of the desalter 2 and the exterior of the desalter. A fluid comprising, for example, desalted oil, may pass through the outlet port and exit the desalter as shown, e.g., by arrow 5.

The outlet ports may include at least one outlet port directing brine comprising a rag layer from the desalter. The brine comprising the rag layer that is directed from the desalter may include varying amounts of brine and rag layer, from mostly brine with the rag layer to mostly the rag layer with some brine. The outlet port directing brine comprising a rag layer from the desalter may be positioned anywhere on the desalter in fluid communication with the brine and/or the rag layer within the desalter. For example, as shown in FIG. 1, the outlet port 3*c* directing brine comprising a rag layer from the desalter may be positioned on the bottom of the desalter 2. The outlet port directing brine comprising a rag layer from the desalter may fluidly communicate between the interior of the desalter and the interior of the bulk separator. For example, as shown in FIG. 1, desalter 2 may include at least one outlet port 3*c* fluidly communicating between the interior of the desalter 2 and the interior of the bulk separator 12. A fluid comprising, for example, brine comprising a rag layer, may pass through the outlet port and exit the desalter as shown, e.g., by arrow 6. Although FIG. 1 shows the outlet port 3*c* positioned on the bottom of the desalter, the outlet port may, additionally or alternatively, be positioned on the side of the desalter. Accordingly, the brine comprising a rag layer may pass through the outlet port positioned on the side of the desalter and exit the desalter.

In some embodiments, the system may further comprise a bulk separator that separates much of the brine from the brine comprising the rag layer which is discharged from the desalter. The bulk separator may be configured in any of a variety of different ways. The bulk separator may take any form and may have any shape, including, for example, that of a tank or receptacle. The bulk separator may be, for example, a settling tank, a gravity separator, or a plate separator, e.g., a coalescing plate interceptor (CPI) separator. An exemplary bulk separator suitable for use in the inventive systems may include a plate separator available from Pall Corporation, Port Washington, N.Y., USA under the trade designation LUCID.

The bulk separator may be positioned at a variety of locations in the system. The bulk separator may be positioned, for example, anywhere downstream of the desalter and anywhere upstream of the cross-flow filter, and/or anywhere downstream of the desalter and anywhere upstream of the separator. Preferably, as shown in FIG. 1, the bulk separator 12 is positioned downstream of the desalter 2, upstream of the separator 25, and upstream of the cross-flow filter 31.

The bulk separator may also include at least one port. In many embodiments, the bulk separator may include three or more ports. In some embodiments, the bulk separator includes three ports. For example, as shown in FIG. 1, the bulk separator may include three ports 13*a*, 13*b*, and 13*c*. Any port may be positioned anywhere on the bulk separator, including the top, bottom, or sides of the bulk separator. More than one port may be positioned on the same side of the bulk separator or on different sides of the bulk separator. For example, as shown in FIG. 1, a port 13*a* may be positioned on the side of the bulk separator 12, a port 13*b* may be positioned on the bottom of the bulk separator 12, and a port 13*c* may be positioned on the top of the bulk separator 12.

The ports may include at least one inlet port directing the brine comprising a rag layer into the bulk separator. The inlet port may fluidly communicate with the desalter outlet port for brine comprising the rag layer, either directly or indirectly via one or more system components. The inlet port directing the brine comprising a rag layer into the bulk separator may fluidly communicate between the interior of the bulk separator and the interior of the desalter. For example, as shown in FIG. 1, bulk separator 12 may include at least one inlet port 13*a* fluidly communicating between the interior of the desalter 2 and the interior of the bulk separator 12. Brine comprising a rag layer may pass through the inlet port and enter the bulk separator from the desalter as shown, e.g., by arrow 6.

The ports may include at least one outlet port directing the brine, e.g., brine largely or substantially free of the rag layer, from the bulk separator. The outlet port directing the brine from the bulk separator may fluidly communicate between the interior of the bulk separator and the exterior of the bulk separator. For example, as shown in FIG. 1, bulk separator 12 may include at least one outlet port 13*b* fluidly communicating with brine below the rag layer and between the interior of the bulk separator 12 and the exterior of the bulk separator. Brine without the rag layer may pass through the outlet port and exit the bulk separator as shown, e.g., by arrow 14.

The ports may include at least one outlet port directing brine comprising the rag layer from the bulk separator. The outlet port may fluidly communicate with the brine comprising the rag layer within the bulk separator. The outlet port may also fluidly communicate between the interior of the bulk separator and the interior of the mixer. For example, as shown in FIG. 1, bulk separator 12 may include at least one outlet port 13*c* fluidly communicating between the interior of the bulk separator 12 and the interior of the mixer 20. Brine comprising the rag layer may pass through the outlet port and exit the bulk separator as shown, e.g., by arrow 15.

The system may further comprise a conduit directing brine comprising the rag layer from the bulk separator to the mixer. The conduit directing brine comprising the rag layer from the bulk separator to the mixer may fluidly communicate between the interior of the bulk separator and the interior of the mixer. For example, as shown in FIG. 1, system 1 may include at least one conduit 13 fluidly communicating between the interior of the bulk separator 12 and the interior of the mixer 20 via outlet port 13*c* and inlet port 21*a*. Although FIG. 1 shows the conduit in fluid communication with an inlet port 13*c* located at the top of the bulk separator, the conduit may be in fluid communication with an inlet port located anywhere on the bulk separator, including the top, bottom, or sides of the bulk separator. The brine comprising the rag layer may exit the bulk separator, pass through the conduit, and enter the mixer as shown, e.g., by arrow 15.

The composition of the rag layer may vary depending, for example, on the nature of the crude oil supplied to the desalter. For example, some rag layers may comprise water-in-oil emulsions, while other rag layers may comprise oil-in-water emulsions. Further, some rag layers may be chemically-stabilized by stabilizing agents such as asphaltenes, and some rag layers may be particulate-stabilized by various solids in the emulsion and may include little or no asphaltenes in the emulsion. One of many examples of a rag layer may comprise about 30% to about 40% hydrocarbon such as oil by weight, about 30% to about 40% brine by weight, about 5% to about 10% solids by weight, and up to about 10% asphaltenes by weight. Varying amounts of these substances may be bound up with one another in the rag layer.

To allow some of these rag layers to be more effectively filtered, one or more of additional hydrocarbon, a demulsifier, a reverse demulsifier, a coagulant, and a flocculant may be added to the rag layer. Adding one or more of the additional hydrocarbon, the demulsifier, the reverse demulsifier, the coagulant, and/or the flocculant to the rag layer may promote destabilization of the rag layer and at least partial, and even substantial, disintegration and decomposition of the rag layer and/or substances in the rag layer, facilitating removal and recovery of the oil and other hydrocarbons bound up in the rag layer. For example, the additional hydrocarbon may dissolve stabilizing agents, such as asphaltenes, in the rag layer. The additional hydrocarbon may also reduce the viscosity of the rag layer and/or establish the oil or other hydrocarbon as the continuous phase of the rag layer. The demulsifier may help break down oil-in-water emulsions, while the reverse demulsifier may break down water-in-oil emulsions. The coagulant and flocculant may aggregate and agglomerate dispersed particles in the rag layer, forming larger aggregates that settle out of the rag layer.

Consequently, in some embodiments, the system may further comprise at least one port directing one or more of additional hydrocarbon, a demulsifier, a reverse demulsifier, a coagulant, and a flocculant into the rag layer. In this regard, the system may include separate ports or, as shown in FIG. 1, a common port 16 for directing the additional hydrocarbon, the demulsifier, the reverse demulsifier, the coagulant, and/or the flocculant into the brine comprising the rag layer.

Any port directing one or more of additional hydrocarbon, a demulsifier, a reverse demulsifier, a coagulant, and a flocculant into the brine comprising the rag layer may be positioned at a variety of locations in the system. In some embodiments, the at least one port directing one or more of additional hydrocarbon, a demulsifier, a reverse demulsifier, a coagulant, and a flocculant into the brine comprising the rag layer is positioned anywhere downstream of the desalter and anywhere upstream of the housing including the cross-flow filter. For example, the at least one port directing one or more of additional hydrocarbon, a demulsifier, a reverse demulsifier, a coagulant, and a flocculant into the brine comprising the rag layer may be positioned anywhere downstream of the desalter and upstream of the bulk separator, anywhere downstream of the bulk separator and anywhere upstream of the mixer, anywhere downstream of the bulk separator and anywhere upstream of the separator, and/or anywhere downstream of the separator and anywhere upstream of the cross-flow filter. For example, as shown in FIG. 1, a common port 16 directing one or more of additional hydrocarbon, a demulsifier, a reverse demulsifier, a coagulant, and a flocculant into the brine comprising the rag layer is positioned downstream of the desalter 2, downstream of the bulk separator 12, upstream of the mixer 20, upstream of the separator 25, and upstream of the cross-flow filter.

Any port directing one or more of additional hydrocarbon, a demulsifier, a reverse demulsifier, a coagulant, and a flocculant into the brine comprising the rag layer may be positioned anywhere on any component of the system. In an embodiment, the at least one port directing one or more of additional hydrocarbon, a demulsifier, a reverse demulsifier, a coagulant, and a flocculant into the brine comprising the rag layer is positioned anywhere on the desalter, the bulk separator, the mixer, the separator, or the working tank, or on a conduit directing the brine comprising the rag layer from the desalter and/or the bulk separator. For example, as shown in FIG. 1, the common port 16 directing one or more of additional hydrocarbon, a demulsifier, a reverse demulsifier, a coagulant, and a flocculant into the brine comprising the rag layer is positioned on a conduit 13 directing the brine comprising the rag layer from the desalter and/or the bulk separator.

The ports may include at least one inlet port directing one or more of additional hydrocarbon, a demulsifier, a reverse demulsifier, a coagulant, and a flocculant into the brine comprising the rag layer. The inlet port(s) directing one or more of additional hydrocarbon, a demulsifier, a reverse demulsifier, a coagulant, and a flocculant into the brine comprising the rag layer may fluidly communicate between an exterior of a source of hydrocarbon and/or demulsifiers (not shown) and the interior of a conduit directing the brine comprising the rag layer from the desalter and/or the bulk separator. For example, as shown in FIG. 1, system 1 may include a common inlet port 16 fluidly communicating between an exterior source(s) of the additional hydrocarbon, the demulsifier, the reverse demulsifier, the coagulant, and/or the flocculant and the interior of a conduit 13 directing the brine comprising the rag layer from the desalter 2 and/or the bulk separator 12. The additional hydrocarbon, demulsifier, reverse demulsifier, coagulant, and/or flocculant may pass through the inlet port (s) and enter the system from the exterior source(s) 17*a*-17*e*, respectively.

In some embodiments of the invention, the system may comprise a mixer which mixes one or more of additional hydrocarbon, a demulsifier, a reverse demulsifier, a coagulant, and a flocculant in the brine comprising the rag layer. The mixer may be configured in any of a variety of different ways. The mixer may take any form and may have any shape, including, for example, that of a tank or in-line receptacle. The mixer may be, for example, a static mixer or a mixing tank.

The mixer may be positioned at a variety of locations in the system. In some embodiments, the mixer may be positioned anywhere downstream of the desalter, anywhere downstream of the at least one inlet port directing one or more of additional hydrocarbon, a demulsifier, a reverse demulsifier, a coagulant, and a flocculant into brine comprising the rag layer, and anywhere upstream of the cross-flow filter. For example, the mixer may be positioned anywhere downstream of the desalter and upstream of the bulk separator, anywhere downstream of the bulk separator and anywhere upstream of the separator, and/or anywhere downstream of the separator and anywhere upstream of the cross-flow filter. Preferably, as shown in FIG. 1, the mixer 20 is positioned downstream of the common inlet port 16 directing one or more of additional hydrocarbon, a demulsifier, a reverse demulsifier, a coagulant, and a flocculant into brine comprising the rag layer and upstream of the separator 25.

The mixer may also include at least one port. In many embodiments, the mixer may include two or more ports. For example, as shown in FIG. 1, the mixer 20 may include two ports 21*a* and 21*b*. Any port may be positioned anywhere on the mixer, including the top, bottom, or sides of the mixer. More than one port may be positioned on the same side of the mixer or on different sides of the mixer. For example, as shown in FIG. 1, ports 21*a* and 21*b* may be positioned on opposite sides of the mixer.

The ports may include at least one inlet port directing brine comprising the rag layer and one or more of additional hydrocarbon, a demulsifier, a reverse demulsifier, a coagulant, and a flocculant into the mixer. The inlet port of the mixer may fluidly communicate between the interior of the mixer and the interior of the desalter or the bulk separator and may fluidly communicate with the outlet port of the desalter or the bulk separator, either directly or indirectly via one or more components of the system. For example, as shown in FIG. 1, mixer 20 may include at least one inlet port 21*a* fluidly communicating between the interior of the mixer 20 and the interior of the bulk separator 12. Brine comprising the rag layer, as well as one or more of additional hydrocarbon, a demulsifier, a reverse demulsifier, a coagulant, and a flocculant, may pass through the inlet port and enter the mixer from the bulk separator as shown, e.g., by arrow 15. Within the mixer, the brine comprising the rag layer and one or more of additional hydrocarbon, a demulsifier, a reverse demulsifier, a coagulant, and a flocculant are mixed with one another.

The ports may include at least one outlet port directing the mixture from the mixer. The outlet port may fluidly communicate between the interior of the mixer and the interior of the separator. For example, as shown in FIG. 1, mixer 20 may include at least one outlet port 21*b* fluidly communicating between the interior of the mixer 20 and the interior of the separator 25. The mixture may pass through the outlet port and exit the mixer as shown, e.g., by arrow 22.

The system may further comprise, for example, a separator that separates the rag layer into a hydrocarbon emulsion and finer solids and brine comprising larger solids. Larger solids may include solid particles having a size of, for example, about 40 microns or more. Finer solids may include solid particles having a size of, for example, less than about 40 microns. The separator may be configured in any of a variety of different ways. The separator may take any form and may have any shape, including, for example, that of a tank or receptacle. For example, the separator may be a settling tank or a mixing tank. Brine and larger solids may collect in the bottom of the separator and the hydrocarbon emulsion and finer solids may, along with any added hydrocarbons and dissolved asphaltenes, collect in the top of the separator.

The separator may also include at least one port. In many embodiments, the separator may include two or more ports. For example, as shown in FIG. 1, the separator may include three ports 26*a*, 26*b*, and 26*c*. Any port may be positioned anywhere on the separator, including the top, bottom, or sides of the separator. More than one port may be positioned on the same side of the separator or on different sides of the separator. For example, as shown in FIG. 1, ports 26*a* and 26*c* may be positioned on the top of the separator 25 and a port 26*b* may be positioned on the bottom of the separator 25.

The ports may include at least one inlet port directing at least brine comprising the rag layer, including, for example, the mixture of the brine comprising a rag layer and one or more of the additional hydrocarbon, the demulsifier, the reverse demulsifier, the coagulant, and the flocculant, into the separator. The inlet port may fluidly communicate between the interior of the separator and the interior of the mixer and may fluidly communicate with the outlet port of the mixer, either directly or via one or more components of the system. For example, as shown in FIG. 1, separator 25 may include at least one inlet port 26*a* fluidly communicating between the interior of the separator 25 and the interior of the mixer 20. The mixture of the brine comprising a rag layer and one or more of the additional hydrocarbon, the demulsifier, the reverse demulsifier, the coagulant, and the flocculant, may pass from the mixer through the inlet port and enter the separator as shown, e.g., by arrow 22.

The ports may include at least one outlet port directing the brine comprising solids from the separator. The outlet port directing brine comprising solids may be positioned anywhere on the separator in fluid communication with the brine comprising solids within the separator. For example, as shown in FIG. 1, the outlet port 26*b* directing brine comprising solids from the separator may be positioned on the bottom of the separator 25. The outlet port directing the brine comprising solids from the separator may fluidly communicate between the interior of the separator and the exterior of the separator. For example, as shown in FIG. 1, separator 25 may include at least one outlet port 26*b* fluidly communicating between the interior of the separator 25 and the exterior of the separator. Brine comprising solids may pass through the outlet port and exit the separator as shown, e.g., by arrow 27.

The ports may include at least one outlet port directing the hydrocarbon emulsion and finer solids from the separator. The outlet port directing the hydrocarbon emulsion from the separator may be positioned anywhere on the separator in fluid communication with the hydrocarbon emulsion within the separator. For example, as shown in FIG. 1, the outlet port 26*c* directing hydrocarbon emulsion from the separator may be positioned on the top of the separator 25. The outlet port directing the hydrocarbon emulsion from the separator may fluidly communicate between the interior of the separator and the interior of the working tank. For example, as shown in FIG. 1, separator 25 may include at least one outlet port 26*c* fluidly communicating between the interior of the separator 25 and the interior of the working tank 37. The hydrocarbon emulsion and finer solids, along with any added hydrocarbons and dissolved asphaltenes, may pass through the outlet port and exit the separator as shown, e.g., by arrow 28.

In many embodiments, the system may further comprise a working tank. The working tank may be configured in any of a variety of different ways. The working tank may take any form and may have any shape, including, for example, that of a tank or receptacle. The working tank may be positioned at a variety of locations in the system. The working tank may be positioned, for example, anywhere downstream of the desalter and anywhere upstream of the housing including the cross-flow filter, or anywhere downstream of the separator and anywhere upstream of the housing including the cross-flow filter. For example, as shown in FIG. 1, the working tank 37 is positioned downstream of the separator 25 and upstream of the housing 30 including the cross-flow filter.

The working tank may also include at least one port. In many embodiments, the working tank may include two or more ports. For example, as shown in FIG. 1, the working tank may include three ports 38*a*, 38*b*, and 38*c*. Any port may be positioned anywhere on the working tank, including the top, bottom, or sides of the working tank. More than one port may be positioned on the same side of the working tank or on different sides of the working tank. For example, as shown in FIG. 1, ports 38*a*, 38*c* may be positioned on the top of the working tank and port 38*b* may be positioned on the bottom of the working tank.

The ports may include at least one inlet port directing the hydrocarbon emulsion and finer solids, along with any added hydrocarbon and dissolved asphaltenes, into the working tank. The inlet port directing the hydrocarbon emulsion and finer solids into the working tank may fluidly communicate between the interior of the working tank and the interior of the separator and may fluidly communicate with the outlet port for the hydrocarbon emulsion of the separator, either directly or via one or more components of the system. For example, as shown in FIG. 1, working tank 37 may include at least one inlet port 38*a* fluidly communicating between the interior of the working tank 37 and the interior of the separator 25. The hydrocarbon emulsion and finer solids may pass through the inlet port and enter the working tank from the separator as shown, e.g., by arrow 28.

The ports may include at least one outlet port directing the hydrocarbon emulsion and finer solids, along with any added hydrocarbon and dissolved asphaltenes, from the working tank. The outlet port may be positioned anywhere on the working tank in fluid communication with the hydrocarbon emulsion within the working tank. The outlet port directing the hydrocarbon emulsion and finer solids from the working tank may fluidly communicate between the interior of the working tank and the interior of the housing including the cross-flow filter. For example, as shown in FIG. 1, working tank 37 may include at least one outlet port 38*b* fluidly communicating between the interior of the working tank 37 and the interior of the housing 30 including the cross-flow filter. A hydrocarbon emulsion may pass through the outlet port and exit the working tank as shown, e.g., by arrow 39.

The ports may also include at least one inlet port directing retentate from the cross-flow filter into the working tank. The inlet port directing the retentate into the working tank may fluidly communicate between the interior of the working tank and the retentate region on the feed side of the cross-flow filter. For example, as shown in FIG. 1, working tank 37 may include at least one inlet port 38*c* fluidly communicating between the interior of the working tank 37 and the retentate region on the feed side of the cross-flow filter 31 on the interior of the housing 30. The retentate may pass through the inlet port and enter the working tank from the retentate region on the feed side of the cross-flow filter as shown, e.g., by arrow 40.

The system may further comprise a housing including a cross-flow filter that separates the hydrocarbon emulsion and finer solids into a permeate comprising filtered hydrocarbon, including oil and/or other hydrocarbons, and a retentate comprising oil, brine, undissolved asphaltenes, and/or solids. The housing may be configured in any of a variety of different ways. The housing may take any form and may have any shape, including, for example, that of a casing, capsule, or receptacle. The housing may be made of any of a variety of different materials suitable for the hydrocarbon being separated. For example, for the separation of brine from hydrocarbon, the housing may be made of any material suitable for contacting the hydrocarbon being filtered. Exemplary materials for the housing may include metal and plastic.

The housing may also include at least one port. In many embodiments, the housing may include three or more ports. For example, as shown in FIG. 1, the housing may include three ports 32*a*, 32*b*, and 32*c*. Any port may be positioned anywhere on the housing, including the top, bottom, or sides of the housing. More than one port may be positioned on the same side of the housing or on different sides of the housing. For example, as shown in FIG. 1, inlet port 32*a* may be positioned on the bottom of the housing 30, outlet port 32*b* may be positioned on the side of the housing 30, and outlet port 32*c* may be positioned on the top of the housing 30.

The ports may include at least one inlet port, e.g., a feed port, directing the hydrocarbon emulsion and finer solids as feed fluid into the housing. The inlet port directing the hydrocarbon emulsion into the housing may fluidly communicate between the interior of the working tank and the interior of the housing and may fluidly communicate with the outlet port for the hydrocarbon emulsion of the working tank, either directly or via one or more components of the system. For example, as shown in FIG. 1, housing 30 may include at least one inlet port 32*a* fluidly communicating between the interior of the working tank 37 and the upstream or feed side of the cross-flow filter 31 on the interior of the housing 30. A hydrocarbon emulsion including, for example, brine and hydrocarbon and finer solids, may pass through the inlet port and enter the housing from the working tank as shown, e.g., by arrow 39. The hydrocarbon emulsion may pass along the feed side of the cross-flow filter, and a portion of the hydrocarbon emulsion, e.g., oil and other hydrocarbons, may pass through the cross-flow filter as permeate.

The ports may include at least one outlet port, e.g., a permeate outlet, directing permeate from the housing. The outlet port directing permeate from the housing may fluidly communicate between the interior of the housing and the exterior of the housing. For example, as shown in FIG. 1, housing 30 may include at least one outlet port 32*b* fluidly communicating between the permeate side of the cross-flow filter 31 on the interior of the housing 30 and the exterior of the housing. A permeate comprising, for example, filtered hydrocarbon, may pass through the outlet port and exit the housing as shown, e.g., by arrow 34.

The portion of the hydrocarbon emulsion that does not pass through the cross-flow filter, i.e., the retentate, may pass to a retentate region on the feed side of the cross-flow filter. The ports may include at least one outlet port, e.g., a retentate outlet, directing retentate from the housing. The outlet port directing retentate from the housing may fluidly communicate between the interior of the housing and the interior of the working tank. For example, as shown in FIG. 1, housing 30 may include at least one outlet port 32*c* fluidly communicating between the retentate region on the feed side of the cross-flow filter 31 on the interior of the housing 30 and the interior of the working tank via inlet port 38*c*, e.g., between the retentate outlet port of the housing and the retentate inlet port of the working tank. A retentate comprising, for example, residual oil, brine, asphaltenes, and/or solids, may pass through the outlet port, exit the housing, and pass into the working tank as shown, e.g., by arrow 40.

The cross-flow filter may be configured in any of a variety of different ways. Exemplary configurations for the cross-flow filter may include, for example, a hollow, generally cylindrical configuration, such as a hollow log or hollow pleated configuration. Alternatively, the cross-flow filter may comprise hollow fiber membranes. Any suitable cross-flow filter configuration or cross-flow filter media may be selected. One material for the cross-flow filter media may include a ceramic. Another material for the cross-flow filter may include a metal. Another material for the cross-flow filter may include one or more polymers. In many embodiments, the material for the cross-flow filter may be hydrophobic. Exemplary cross-flow filter media suitable for use in the inventive system may include MEMBRALOX ceramic membrane filter elements, SCHUMASIV ceramic membrane filter elements, and ACCUSEP metal filter elements, available from Pall Corporation, Port Washington, N.Y., USA. The cross-flow filter advantageously removes solids and facilitates removal of hydrocarbon from the hydrocarbon emulsion.

The cross-flow filter or filter medium may be permeable and may have any of a wide range of molecular cutoffs or removal ratings, including, for example, from microporous or coarser to ultraporous or finer. For example, the filter medium may have a removal rating in the range from about 0.005 microns or less to about 100 microns or more. Without being bound to a particular theory or mechanism, it is believed that the brine may be in the form of emulsified drops and/or encapsulated solids, and the separation of the brine from the hydrocarbon may occur by size exclusion. In many embodiments, the cross-flow filter or filter medium may be hydrophobic or wetted with hydrocarbon and may, for example, also separate brine from the hydrocarbon by rejecting aqueous drops.

The system may further comprise a pump. The pump may be configured in a variety of different ways. The pump may fluidly communicate between the interior of the working tank and the interior of the housing including the cross-flow filter. As shown in FIG. 1, for example, pump 40 may fluidly communicate between the downstream side of the working tank 37 and the upstream side of cross-flow filter 31 via, for example, inlet port 32*a* and outlet port 38*b*. The pump may increase the pressure and/or flow rate of the hydrocarbon emulsion entering the housing on the upstream side of cross-flow filter 31 and may circulate fluid between the working tank and the housing and along the feed side of the cross-flow filter.

Figure 2:
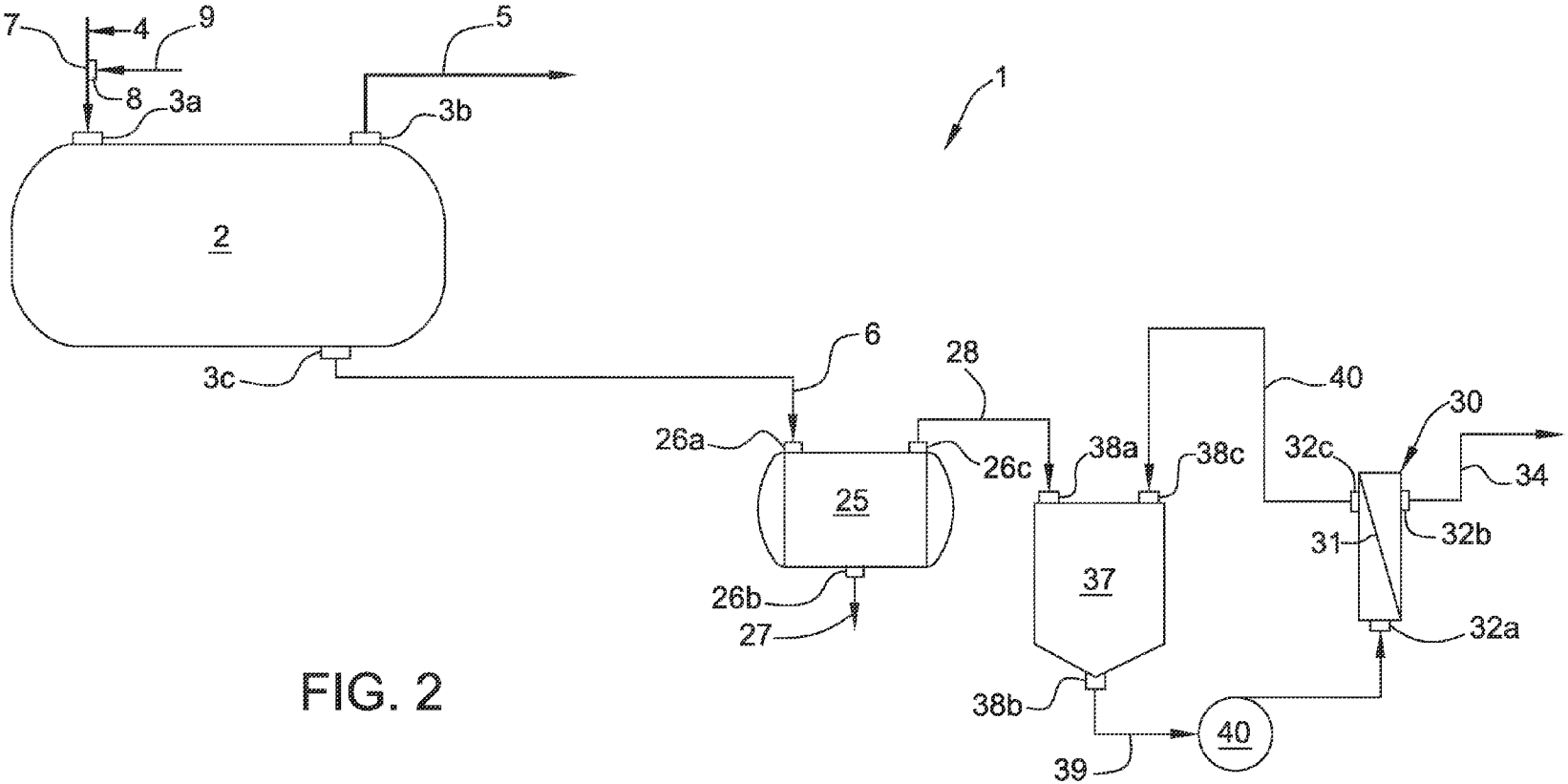
FIG. 2 is a representative schematic view, not to scale, of another embodiment of a system for processing crude oil.

Another example of a system embodying the invention is shown in FIG. 2. The system may comprise, for example, a desalter, a separator, a working tank, and a housing including a cross-flow filter.

The system may comprise, for example, a desalter that separates oil from brine comprising a rag layer. The desalter may be configured in any of a variety of different ways. For example, the desalter, including the inlet(s) and the outlets, may be configured and may function as described herein with respect to other aspects of the invention. For example, as shown in FIG. 2, the system may comprise desalter 2.

The system may, or may not, include an inlet port for the one or more of the additional hydrocarbon, demulsifier, reverse demulsifier, coagulant, and flocculant and a mixer which may be positioned, for example, between the desalter and the separator as described herein with respect to other aspects of the invention.

The system may further comprise, for example, a separator that separates the brine comprising the rag layer into brine with larger solids and the hydrocarbon emulsion with finer solids. The separator may be configured in any of a variety of different ways. For example, the separator may be configured and may function as described herein with respect to other aspects of the invention. For example, as shown in FIG. 2, the system may comprise separator 25.

The separator may also include at least one port. In many embodiments, the separator may include two or more ports. For example, as shown in FIG. 2, the separator 25 may include three ports 26*a*, 26*b*, and 26*c*. Any port may be positioned anywhere on the separator, for example, as described herein with respect to other aspects of the invention.

The ports may include at least one inlet port 26*a* directing brine comprising the rag layer into the separator. The inlet port may fluidly communicate with the desalter outlet port for brine comprising the rag layer, either directly or via one or more system components. The inlet port directing the brine comprising the rag layer into the separator may fluidly communicate between the interior of the separator and the interior of the desalter. For example, as shown in FIG. 2, separator 25 may include at least one inlet port 26*a* fluidly communicating between the interior of the separator 25 and the interior of the desalter 2. The brine comprising a rag layer may pass through the inlet port and enter the separator from the desalter as shown, e.g., by arrow 6.

The ports may include at least one outlet port 26*b* directing the brine comprising larger solids from the separator and at least one outlet port 26*c* directing the hydrocarbon emulsion and finer solids from the separator. The outlet port directing the brine comprising lager solids from the separator and the at least one outlet port directing the hydrocarbon emulsion and finer solids from the separator may be configured in any of a variety of different ways, for example, as described herein with respect to other aspects of the invention.

The system may further comprise a working tank, a housing including a cross-flow filter, and a pump. For example, as shown in FIG. 2, system 1 may comprise a working tank 37, a housing 30 including a cross-flow filter 31, and a pump 40, which may be similar to those of FIG. 1. The working tank, housing, cross-flow filter, and pump may be configured and may function in any of a variety of different ways, for example, as described herein with respect to other aspects of the invention.

Many systems embodying the invention may recirculate the hydrocarbon emulsion and finer solids along a cross-flow filter. Some recirculating systems, including the systems shown in FIGS. 1 and 2, may include both a separator 25 and a separate working tank 37. Other recirculating systems may be differently configured. For example, the functions of the separator and working tank may be combined in a single vessel, e.g., a single separator. For example, brine comprising the rag layer may be supplied to the separator from the desalter or the bulk separator and retentate may be supplied to the separator from the cross-flow filter via one or two inlet ports. The separator may separate the hydrocarbon emulsion having finer solids from brine and larger solids in a variety of ways. For example, the brine and larger solids may settle below the hydrocarbon emulsion and finer solids. Brine and larger solids may be taken from the separator, for example, from an outlet port in a lower portion of the separator. The hydrocarbon emulsion and finer solids may be taken from the separator, for example, from another outlet port in an upper portion of the separator and supplied to the cross flow filter, with or without a pump.

Figure 3:
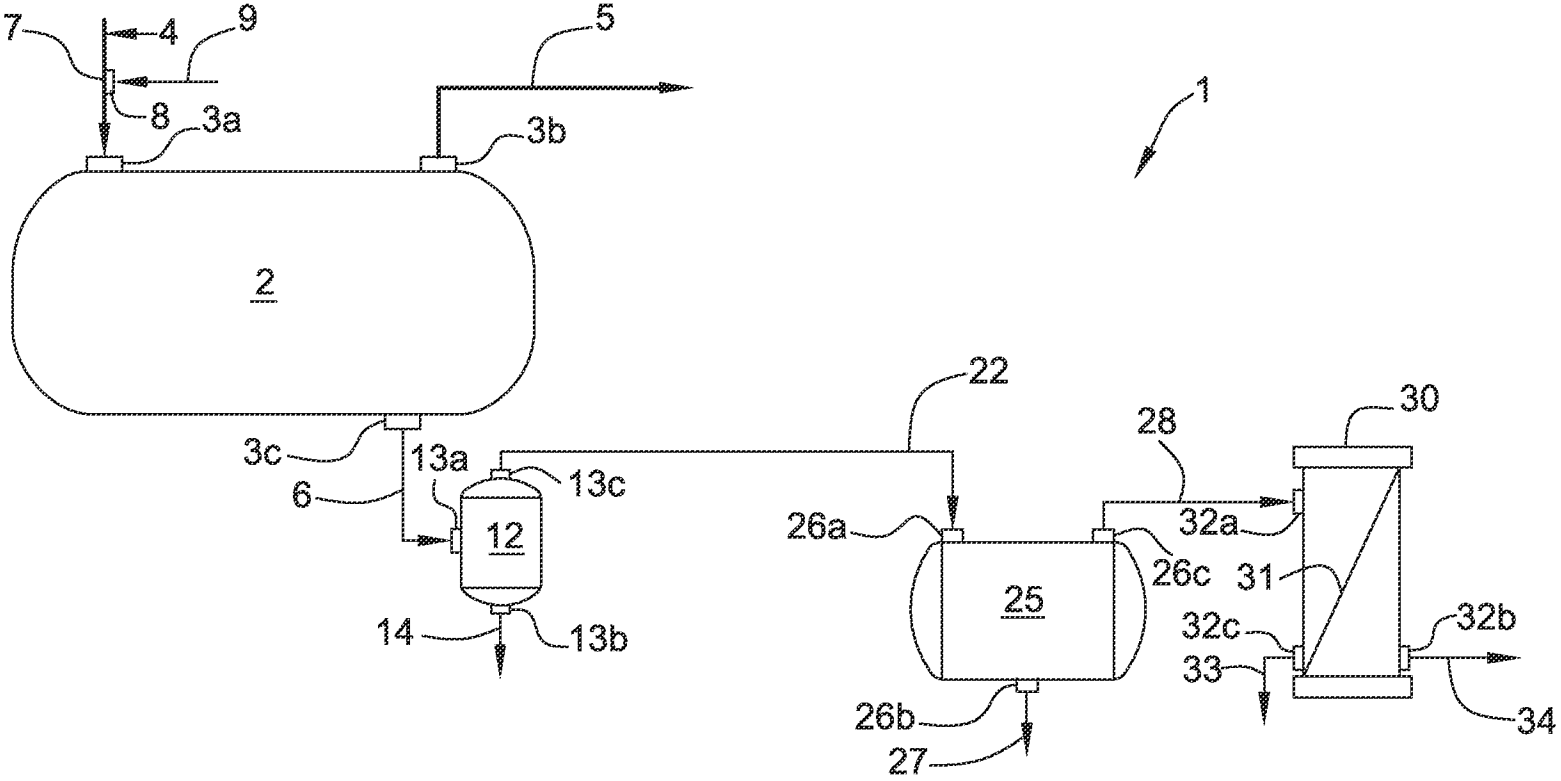
FIG. 3 is a representative schematic view, not to scale, of still another embodiment of a system for processing crude oil.

Still other systems embodying the invention may not recirculate the retentate along the cross flow filter. An example of a single-pass system embodying of the invention is shown in FIG. 3. The system may comprise, for example, a desalter, a bulk separator, a separator, and a housing including a cross-flow filter.

The system may comprise, for example, a desalter that separates oil from brine comprising a rag layer. The desalter may be configured in any of a variety of different ways. For example, the desalter, including the inlet(s) and outlets, may be configured and may function as described herein with respect to other aspects of the invention. For example, as shown in FIG. 3, the system may comprise desalter 2.

The system may further comprise a bulk separator that separates brine from the brine comprising the rag layer. The bulk separator may be configured and may function in any of a variety of different ways. For example, the bulk separator, including the inlet and outlets, may be positioned, may be configured and may function as described herein with respect to other aspects of the invention. For example, as shown in FIG. 3, the system may comprise bulk separator 12.

The system may, or may not, include an inlet port for the one or more of the additional hydrocarbon, demulsifier, reverse demulsifier, coagulant, and flocculant and a mixer which may be positioned, for example, between the desalter or the bulk separator and the separator as described herein with respect to other aspects of the invention.

The system may further comprise, for example, a separator that separates the brine comprising the rag layer into brine with larger solids and the hydrocarbon emulsion with finer solids. The separator may be configured in any of a variety of different ways. For example, the separator may be configured and may function as described herein with respect to other aspects of the invention. For example, as shown in FIG. 3, the system may comprise separator 25.

The separator may also include at least one port. In many embodiments, the separator may include two or more ports, e.g. For example, as shown in FIG. 3, the separator 25 may include three ports 26*a*, 26*b*, and 26*c*. Any port may be positioned anywhere on the separator, for example, as described herein with respect to other aspects of the invention.

The ports may include at least one inlet port directing brine comprising the rag layer into the separator. The inlet port may fluidly communicate with the bulk separator outlet port for brine comprising the rag layer, either directly or via one or more system components. The inlet port directing the brine comprising the rag layer into the separator may fluidly communicate between the interior of the separator and the interior of the bulk separator. For example, as shown in FIG. 3, separator 25 may include at least one inlet port 26*a* fluidly communicating between the interior of the separator 25 and the interior of the bulk separator 12. The brine comprising a rag layer may pass through the inlet port and enter the separator from the bulk separator as shown, e.g., by arrow 22.

The ports may include at least one outlet port directing the brine comprising larger solids from the separator and at least one outlet port directing the hydrocarbon emulsion and finer solids from the separator. The outlet port directing the brine comprising larger solids from the separator and the at least one outlet port directing the hydrocarbon emulsion from the separator may be configured in any of a variety of different ways, for example, as described herein with respect to other aspects of the invention. For example, as shown in FIG. 3, the ports may include at least one outlet port 26*b* directing the brine comprising solids from the separator and at least one outlet port 26*c* directing the hydrocarbon emulsion from the separator.

The system may further comprise a housing including a cross-flow filter. The housing and the cross-flow filter each may be configured in any of a variety of different ways, for example, as described herein with respect to other aspects of the invention. For example, as shown in FIG. 3, the system may comprise housing 30 including cross-flow filter 31.

The housing may also include at least one port. In many embodiments, the housing may include three or more ports. For example, as shown in FIG. 3, the housing may include three ports 32*a*, 32*b*, and 32*c*. Any port may be positioned anywhere on the housing, for example, as described herein with respect to other aspects of the invention.

The ports may include at least one inlet port, e.g., a feed port, directing the hydrocarbon emulsion and finer solids into the housing. The inlet port directing the hydrocarbon emulsion into the housing may fluidly communicate between the interior of the separator and the interior of the housing and may fluidly communicate with the separator outlet port for the hydrocarbon emulsion, either directly or via one or more components of the system. For example, as shown in FIG. 3, housing 30 may include at least one inlet port 32*a* fluidly communicating between the interior of the separator 25 and the upstream or feed side of the cross-flow filter 31 on the interior of the housing 30. A pump which increases the pressure and/or flow rate of the hydrocarbon emulsion may, or may not, be included, for example, between the separator and the housing of the cross-flow filter. The hydrocarbon emulsion including, for example, brine and hydrocarbon and finer solids, may pass through the inlet port and enter the housing from the separator as shown, e.g., by arrow 28. The hydrocarbon emulsion and finer solids may pass along the feed side of the cross-flow filter, and a portion of the hydrocarbon emulsion, e.g., oil and other hydrocarbons, may pass through the cross-flow filter as permeate.

The ports may include at least one outlet port, e.g., a permeate port, directing permeate from the housing. The outlet port directing permeate from the housing may fluidly communicate between the interior of the housing and the exterior of the housing. For example, as shown in FIG. 3, housing 30 may include at least one outlet port 32*b* fluidly communicating between the permeate side of the cross-flow filter 31 on the interior of the housing 30 and the exterior of the housing. A permeate comprising, for example, filtered hydrocarbon, may pass through the outlet port and exit the housing as shown, e.g., by arrow 34.

The portion of the hydrocarbon emulsion that does not pass through the cross-flow filter, i.e., the retentate, may pass to the retentate region on the feed side of the cross-flow filter. The ports may include at least one outlet port. e.g. a retentate port, directing retentate from the housing. The outlet port directing retentate from the housing may fluidly communicate between the interior of the housing and the exterior of the housing. For example, as shown in FIG. 3, housing 30 may include at least one outlet port 32*c* fluidly communicating between the retentate region on the feed side of the cross-flow filter 31 on the interior of the housing 30 and the exterior of the housing. A retentate comprising, for example, some oil, brine, asphaltenes, and/or solids, may pass through the outlet port and exit the housing as shown, e.g., by arrow 33. The feed fluid, i.e., the hydrocarbon emulsion and finer solids, may thus pass in a single pass without recirculation along the feed side of the cross-flow filter.

Figure 4:
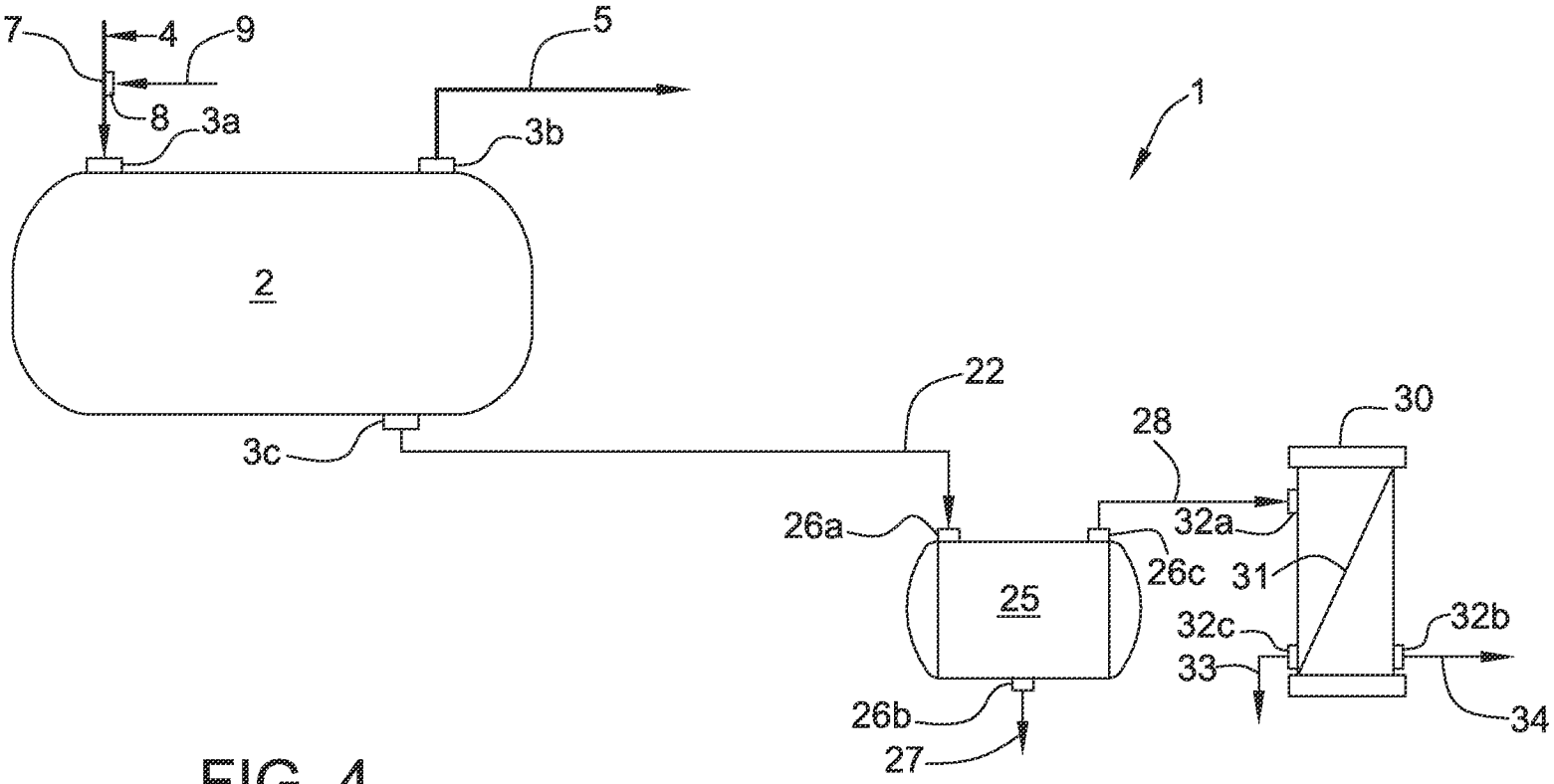
FIG. 4 is a representative schematic view, not to scale, of still another embodiment of a system for processing crude oil.

Another example of a system embodying the invention is shown in FIG. 4. The system may comprise, for example, a desalter, a separator, and a housing including a cross-flow filter.

The system may comprise, for example, a desalter that separates oil from brine comprising a rag layer. The desalter may be configured and may function in any of a variety of different ways. For example, the desalter, including the inlet (s) and outlets, may be configured as described herein with respect to other aspects of the invention. For example, as shown in FIG. 4, the system may comprise desalter 2.

The system may, or may not, include an inlet port for the one or more of the additional hydrocarbon, demulsifier, reverse demulsifier, coagulant, and flocculant and a mixer which may be positioned, for example, between the desalter and the separator as described herein with respect to other aspects of the invention.

The system may further comprise a separator that separates the brine comprising the rag layer into brine comprising larger solids and the hydrocarbon emulsion with finer solids of the rag layer. The separator may be configured in any of a variety of different ways. For example, the separator may be configured as described herein with respect to other aspects of the invention. For example, as shown in FIG. 4, the system may comprise separator 25.

The separator may also include at least one port. In many embodiments, the separator may include two or more ports. For example, as shown in FIG. 4, the separator 25 may include three ports 26*a*, 26*b*, and 26*c*. Any port may be positioned anywhere on the separator, for example, as described herein with respect to other aspects of the invention.

The ports may include at least one inlet port directing brine comprising the rag layer into the separator. The inlet port may fluidly communicate with the desalter outlet port for brine comprising the rag layer, either directly or via one or more system components. The inlet port may fluidly communicate between the interior of the separator and the interior of the desalter. For example, as shown in FIG. 4, separator 25 may include at least one inlet port 26*a* fluidly communicating between the interior of the separator 25 and the interior of the desalter 2. The brine comprising a rag layer may pass through the inlet port and enter the separator from the desalter as shown, e.g., by arrow 22.

The ports may include at least one outlet port directing the brine comprising larger solids from the separator and at least one outlet port directing the hydrocarbon emulsion and finer solids from the separator. The outlet port directing the brine comprising larger solids from the separator and the at least one outlet port directing the hydrocarbon emulsion and finer solids from the separator may be configured in any of a variety of different ways, for example, as described herein with respect to other aspects of the invention. For example, as shown in FIG. 4, the ports may include at least one outlet port 26*b* directing the brine comprising solids from the separator and at least one outlet port 26*c* directing the hydrocarbon emulsion from the separator.

The system may further comprise, for example, a housing including a cross-flow filter. The housing and the cross-flow filter each may be configured and may function in any of a variety of different ways, for example, as described herein with respect to other aspects of the invention. For example, as shown in FIG. 4, the system may comprise housing 30 including cross-flow filter 31 and it may be similar to the housing 30 including the cross-flow filter 31 of FIG. 3.

The housing may also include at least one port. In many embodiments, the housing may include three or more ports. For example, as shown in FIG. 4, the housing may include three ports 32*a*, 32*b*, and 32*c*. Any port may be positioned anywhere on the housing, for example, as described herein with respect to other aspects of the invention.

The ports may include at least one inlet port, e.g., a feed port, directing the hydrocarbon emulsion and finer solids into the housing. The inlet port directing the hydrocarbon emulsion into the housing may fluidly communicate between the interior of the separator and the interior of the housing and may fluidly communicate with the separator outlet port for the hydrocarbon emulsion, either directly or via one or more system components. For example, as shown in FIG. 4, housing 30 may include at least one inlet port 32*a* fluidly communicating between the interior of the separator 25 and the upstream or feed side of the cross-flow filter 31 on the interior of the housing 30. A pump which increases the pressure and/or flow rate of the hydrocarbon emulsion may, or may not, be included, for example, between the separator and the housing of the cross-flow filter. A hydrocarbon emulsion including, for example, brine and hydrocarbon and finer solids, may pass through the inlet port and enter the housing from the separator as shown, e.g., by arrow 28. The hydrocarbon emulsion and finer solids may pass along the feed side of the cross-flow filter, and a portion of the hydrocarbon emulsion, e.g., oil and other hydrocarbons, may pass through the cross-flow filter as permeate.

The ports may include at least one outlet port, e.g., a permeate port, directing permeate from the housing. The outlet port directing permeate from the housing may fluidly communicate between the interior of the housing and the exterior of the housing. For example, as shown in FIG. 4, housing 30 may include at least one outlet port 32*b* fluidly communicating between the permeate side of the cross-flow filter 31 on the interior of the housing 30 and the exterior of the housing. A permeate comprising, for example, filtered hydrocarbon, may pass through the outlet port and exit the housing as shown, e.g., by arrow 34.

The portion of the hydrocarbon emulsion that does not pass through the cross-flow filter, i.e., the retentate, may pass to the retentate region on the feed side of the cross-flow filter. The ports may include at least one outlet port, e.g., a retentate port, directing retentate from the housing. The outlet port directing retentate from the housing may fluidly communicate between the interior of the housing and the exterior of the housing. For example, as shown in FIG. 4, housing 30 may include at least one outlet port 32*c* fluidly communicating between the retentate region on the feed side of the cross-flow filter 31 on the interior of the housing 30 and the exterior of the housing. A retentate comprising, for example, residual oil, brine, asphaltenes, and/or solids, may pass through the outlet port and exit the housing as shown, e.g., by arrow 33. The feed fluid, i.e., the hydrocarbon emulsion and finer solids, may thus pass in a single pass without recirculation along the feed side of the cross-flow filter.

Embodiments of the invention further include numerous methods of processing crude oil. The methods may include processing the crude oil in any of a variety of different ways. For example, the methods may comprise adding water to the crude oil to produce brine and oil and a rag layer including an emulsion of brine and oil and solids; separating oil from brine including producing brine comprising a rag layer; separating the rag layer into a hydrocarbon emulsion having finer solids and brine comprising larger solids; and passing the hydrocarbon emulsion and finer solids along a cross-flow filter to produce a retentate comprising brine and solids and a permeate comprising hydrocarbon.

Still other embodiments of the invention provide methods of processing crude oil comprising passing the crude oil through a desalter, including separating oil from brine comprising a rag layer and removing the brine comprising a rag layer from the desalter via a first port and removing the oil via a second port; passing the rag layer through a separator including separating the rag layer into a hydrocarbon emulsion having finer solids and brine comprising larger solids, including removing the brine comprising larger solids from the separator via a third port and removing the hydrocarbon emulsion and finer solids from the separator via a fourth port; and filtering the hydrocarbon emulsion using a cross-flow filter to produce a retentate comprising brine and solids and a permeate comprising hydrocarbon, including removing the retentate from the cross-flow filter via a fifth port and removing the permeate from the cross-flow filter via a sixth port.

In many embodiments, methods may comprise adding water to the crude oil to remove metals and/or salts and other dissolvables from the crude oil and to produce an emulsion of brine and oil. The nature of the crude oil, including the chemical composition of the crude oil itself and the amount and composition of the solids and other substances entrained and/or dissolved in the crude oil, may vary widely depending on many factors, including the geological source of the crude oil and the substances added to extract the crude oil from the geological source. In addition to water, various other chemicals, including, for example, demulsifiers and/or corrosion inhibitors, may be added to the crude oil, the water, or the mixture of oil and water (brine) to further treat the crude oil.

Water may be added to the crude oil in any of a variety of different ways. For example, the method may comprise adding water to crude oil prior to, during, and/or after directing the crude oil to the desalter. With reference to the Figures, adding water to the crude oil may comprise adding water to crude oil via water inlet port 8 positioned on a conduit 7 for directing crude oil into a desalter 2. In other embodiments, methods may comprise adding water to crude oil via a water inlet port positioned anywhere on the desalter itself. The water and the crude oil may be combined in the conduit or in the desalter.

Water may be added to the crude oil in varying amounts. In many embodiments, methods may comprise adding water to the crude oil in an amount sufficient to form brine and oil and a rag layer comprising an emulsion of brine and hydrocarbon, including oil, and solids. Water may be added to the oil in an amount sufficient to remove metals and/or salts and other dissolvables from the oil. For example, the methods may comprise adding water to the crude oil in an amount of about 5% water or less to about 10% water or more by volume.

In some embodiments of the invention, adding water to the crude oil to produce brine, oil, and an emulsion of brine and oil may further comprise pressurizing and/or heating the crude oil and/or the water. For example, in the desalter the crude oil and water (brine) may be heated to a temperature in the range from about 200° F. or less to about 300° F. or more. For some embodiments the crude oil and water (brine) may be heated in the range from about 225° F. to about 275° F. In some embodiments, the crude oil and water (brine) may not be heated. The crude oil and water (brine) may be pressurized within the desalter to a pressure in the range from about 10 psig or less to about 200 psig or more. In some embodiments, the crude oil and water (brine) may not be pressurized.

In many embodiments of the invention, adding water to the crude oil comprises combining the water and the crude oil. The water and crude oil may be combined in any of a variety of different ways. In some embodiments of the invention, adding water to the crude oil comprises directing crude oil (or a mixture of crude oil and water) into a desalter. Crude oil (or a mixture of crude oil and water) may be directed into a desalter in any of a variety of different ways. For example, with reference to the Figures, the method may comprise directing crude oil (or a mixture of crude oil and water) from conduit 7 into desalter 2 via inlet 3*a*.

Methods may further comprise separating oil from brine including producing brine comprising a rag layer. Oil may be separated from brine in any of a variety of different ways. In many embodiments of the invention, separating oil from brine may include coalescing the crude oil and water. In some embodiments of the invention, coalescing may comprise applying an electrical field to the emulsion in a desalter, including inducing a dipole in the brine droplets, coalescing the brine droplets, and collecting the brine droplets as an aqueous phase in one portion (e.g., bottom) of the desalter. Separating oil from the brine may further comprise forming an oil phase and collecting the desalted oil in another portion (e.g., top) of the desalter.

Separating oil from the brine may include forming brine comprising a rag layer. A rag layer may be formed in any of a variety of different ways. For example, the rag layer may be formed on top of the brine, e.g., at an interface of the brine and the oil, or may be entrained as droplets or masses, for example, in the brine. The rag layer may include any of several substances, including one or more of oil, brine, asphaltenes, and solids. The composition of the rag layer may vary depending, for example, on the nature of the crude oil. For example, some rag layers may comprise water-in-oil emulsions, while other rag layers may comprise oil-in-water emulsions. Further, some rag layers may be chemically-stabilized by stabilizing agents such as asphaltenes, and some rag layers may be particulate-stabilized by particles in the emulsion and may include little or no asphaltenes in the rag layer. One of many examples of a rag layer may comprise up to about 30% to about 40% oil by weight, about 5% to about 20% solids by weight, about 30% to about 40% brine by weight, and about 0% to about 10% asphaltenes by weight. These substances may be bound up with one another in the hydrocarbon emulsion of the rag layer.

A method may further comprise separately directing the desalted oil and brine comprising a rag layer from the desalter. The desalted oil may be directed from the desalter in any of a variety of different ways. For example, with reference to the Figures, desalted oil may be directed from the desalter 2 via outlet port 3*b* as shown, e.g., by arrow 5. Once discharged, the desalted oil may be further processed, e.g., fractionated. The brine comprising a rag layer may be directed from the desalter in any of a variety of different ways. For example, with reference to the Figures, brine comprising a rag layer may be directed from the desalter 2 via outlet port 3*c* as shown, e.g., by arrow 6, 22. The brine comprising the rag layer which is directed from the desalter may include varying amounts of brine and rag layer, from mostly brine along with the rag layer to mostly the rag layer with some brine.

In some embodiments of the invention, the methods may further comprise separating brine from the brine comprising the rag layer. For example, in embodiments where a significant amount of brine is removed from the desalter along with the rag layer, it may be beneficial to further separate much of the brine from brine comprising the rag layer. Brine may be separated from the brine comprising the rag layer in any of a variety of different ways. For example, separating brine from brine comprising the rag layer may comprise directing the brine comprising the rag layer through a bulk separator. The bulk separator may be configured in any of a variety of different ways. For example, the bulk separator may be configured as described herein with respect to other aspects of the invention.

Excess brine may be separated from brine comprising the rag layer in a bulk separator in a variety of ways, including settling, for example, much of the brine below the rag layer. For example, with reference to FIGS. 1 and 3, separating brine from brine comprising the rag layer may comprise directing the brine comprising a rag layer into a bulk separator 12 via inlet port 13*a* (as shown, e.g., by arrow 6), directing brine from the bulk separator 12 via lower outlet port 13*b* (as shown, e.g., by arrow 14), and directing brine comprising the rag layer from the bulk separator via upper outlet port 13*c* (as shown, e.g., by arrow 22). The method may comprise directing the brine and the brine comprising a rag layer out of the bulk separator. For example, with reference to FIGS. 1 and 3, separating brine from brine comprising the rag layer may comprise directing the brine comprising a rag layer from the bulk separator 12 via outlet port 13*c* (as shown, e.g., by arrow 22) and directing additional brine, i.e., brine without the rag layer, out of the bulk separator 12 via outlet port 13*b* (as shown, e.g., by arrow 14).

In many embodiments, methods comprise separating the rag layer into a hydrocarbon emulsion with finer solids and brine comprising larger solids. The rag layer may be separated into a hydrocarbon emulsion with finer solids and a brine comprising larger solids in any of a variety of different ways including settling the brine and larger solids below the hydrocarbon emulsion and finer solids. In some embodiments of the invention, separating the rag layer into a hydrocarbon emulsion with finer solids and brine comprising larger solids comprises directing the brine comprising the rag layer through a separator. The separator may be, for example, a settling tank. For example, with reference to the Figures, separating the rag layer into a hydrocarbon emulsion with finer solids and brine comprising larger solids may comprise directing the brine comprising the rag layer through separator 25 via inlet port 26*a*, as shown, e.g., by arrow 22. The brine comprising the rag layer may be provided to the separator from the desalter, for example, either directly or via one or more other system components, including the bulk separator or the mixer.

In many embodiments of the invention, separating the rag layer into a hydrocarbon emulsion with finer solids and brine comprising larger solids may comprise settling brine and the larger solids out of the rag layer at the bottom of a separator and collecting a hydrocarbon emulsion and finer solids at the top of a separator. For example, with reference to the Figures, the method may comprise settling brine and larger solids out of the rag layer at the bottom of a separator 25 and collecting a hydrocarbon emulsion and finer solids at the top of a separator 25.

In many embodiments of the invention, separating the rag layer into a hydrocarbon emulsion with finer solids and brine comprising larger solids may comprise directing the brine comprising larger solids out of the separator. Brine comprising larger solids may be directed out of the separator in any of a variety of different ways. For example, with reference to the Figures, the method may comprise directing brine comprising larger solids out of separator 25 via outlet port 26*b*, as shown, e.g., by arrow 27.

In many embodiments of the invention, separating the rag layer into a hydrocarbon emulsion with finer solids and brine comprising larger solids may comprise directing the hydrocarbon emulsion and finer solids out of the separator. The hydrocarbon emulsion may be directed out of the separator in any of a variety of different ways. For example, with reference to the Figures, the method may comprise directing the hydrocarbon emulsion and finer solids out of separator 25 via outlet port 26*c*, as shown, e.g., by arrow 28.

The methods further comprise passing the hydrocarbon emulsion and finer solids as feed fluid along a cross-flow filter to produce a retentate comprising mostly brine and solids and a permeate comprising mostly hydrocarbon, including oil and other hydrocarbons. The cross-flow filter may be configured in any of a variety different ways. For example, the cross-flow filter may be configured as described herein with respect to other aspects of the invention. The hydrocarbon emulsion and finer solids may be passed along a cross-flow filter in any of a variety of different ways. For example, with reference to the Figures, passing the hydrocarbon emulsion along a cross-flow filter comprises directing the hydrocarbon emulsion and finer solids through a housing 30 and along cross-flow filter 31.

In many embodiments of the invention, passing the hydrocarbon emulsion and finer solids as feed fluid along a cross-flow filter comprises passing the hydrocarbon emulsion and finer solids along the upstream or feed side of a cross-flow filter. The hydrocarbon emulsion may be passed along the upstream side of a cross-flow filter in any of a variety of different ways. For example, with reference to the Figures, passing the hydrocarbon emulsion along the upstream side of a cross-flow filter comprises passing the hydrocarbon emulsion into the housing 30 via inlet port 32*a* (as shown, e.g., by arrow 28) and along the upstream side of cross-flow filter 31.

In some embodiments of the invention, methods may further comprise increasing the pressure and/or flow rate of the hydrocarbon emulsion and finer solids directed to the upstream side of the cross-flow filter. The pressure and/or flow rate of the hydrocarbon emulsion directed to the upstream side of the cross-flow filter may be increased in any of a variety of different ways. For example, directing hydrocarbon emulsion and finer solids along the upstream side of the cross-flow filter may comprise directing the hydrocarbon emulsion and finer solids through a pump that increases the pressure and/or flow rate. For some embodiments, the pressure may be increased to increase the flow rate of the hydrocarbon emulsion along the upstream side of the cross-flow filter. For example, the pressure may be increased to a pressure in the range from about 30 pounds per square inch gauge (psig) or less to about 300 psig or more. The pump may be positioned in a variety of locations in the system to increase the pressure and/or flow rate of the hydrocarbon emulsion and finer solids, including, for example, between the separator and the housing comprising the cross-flow filter. In other embodiments, the pressure and/or flow rate of the hydrocarbon emulsion may not be increased, for example, beyond those at the hydrocarbon emulsion outlet of the separator and no pump may be included.

In many embodiments of the invention, passing the hydrocarbon emulsion and finer solids as feed fluid along the upstream side of a cross-flow filter comprises forming a permeate comprising hydrocarbon and a retentate comprising brine and solids. A permeate comprising hydrocarbon and a retentate comprising brine and solids may be formed in any of a variety of different ways. For example, a method may comprise passing a portion of the feed fluid as permeate from the upstream side of the cross-flow filter, through the cross-flow filter, and to the downstream side of the cross-flow filter, and passing the remainder of the feed fluid as retenate to a retentate region on the upstream side of the cross-flow filter. In many embodiments of the invention, the permeate may comprise filtered hydrocarbon, including oil and other hydrocarbons, and the retentate may comprise any one or more of residual oil, brine, asphaltenes, and solids.

In many embodiments of the invention, passing the hydrocarbon emulsion and finer solids along a cross-flow filter comprises passing the permeate out of the housing comprising the cross-flow filter. The permeate may be passed out of the housing comprising the cross-flow filter in any of a variety of different ways. For example, with reference to the Figures, the method may comprise passing the permeate out of the housing 30 comprising the cross-flow filter 31 via outlet port 32*b* as shown, e.g., by arrow 34.

In many embodiments of the invention, passing the hydrocarbon emulsion and finer solids along a cross-flow filter comprises passing the retentate out of the housing comprising the cross-flow filter. The retentate may be passed out of the housing comprising the cross-flow filter in any of a variety of different ways. For example, with reference to the Figures, the method may comprise passing the retentate out of the housing 30 comprising the cross-flow filter 31 via outlet port 32*c* as shown, e.g., by arrow 33.

In some embodiments of the invention, methods may further comprise recirculating the retentate along the feed side of the cross-flow filter. Recirculating the retentate may allow recovery of a greater percentage of the hydrocarbon from the hydrocarbon emulsion of the rag layer. The retentate may be recirculated in any of a variety of different ways. In some embodiments, recirculating the retentate may comprise directing the hydrocarbon emulsion and finer solids to the cross-flow filter via a working tank. The hydrocarbon emulsion and finer solids may be directed to the working tank in any of a variety of different ways. For example, with reference to FIGS. 1 and 2, directing the hydrocarbon emulsion to the cross-flow filter via a working tank comprises directing the hydrocarbon emulsion from a separator 25 into a working tank 37 via inlet port 38*a* as shown, e.g., by arrow 28.

Methods may also comprise directing the hydrocarbon emulsion and finer solids from the working tank to the housing comprising a cross-flow filter. The hydrocarbon emulsion may be directed from the working tank to the housing comprising a cross-flow filter in any of a variety of different ways. For example, with reference to FIGS. 1 and 2, directing the hydrocarbon emulsion from the working tank to the housing comprising a cross-flow filter comprises directing the hydrocarbon emulsion and finer solids from the working tank 37 to the housing 30 comprising a cross-flow filter 31 via outlet port 38*b* and inlet port 32*a*.

In some embodiments of the invention, recirculating the retentate may further comprise increasing the pressure and/or flow rate of the hydrocarbon emulsion and finer solids directed to the upstream side of the cross-flow filter from the working tank. The pressure and/or flow rate of the hydrocarbon emulsion directed to the upstream side of the cross-flow filter may be increased in any of a variety of different ways. For example, with reference to FIGS. 1 and 2, the pressure of the hydrocarbon emulsion directed to the upstream side of the cross-flow filter may be increased via pump 40 which may be located, for example, upstream of the inlet port 32*a* of the housing 30. For some embodiments, the pressure may be increased to a pressure in the range from about 30 psig or less to about 300 psig or more. Flow rates of the hydrocarbon emulsion and finer solids may vary based on, for example, the size of the refinery and the amount of emulsion or rag layer formed. For some embodiments, the flow rate of the hydrocarbon emulsion and finer solids may be in the range of from about 10 gallons per minute (gpm) or less to about 1,000 gpm or more.

Directing the hydrocarbon emulsion and finer solids from the working tank through the housing of the cross-flow filter may further include passing the hydrocarbon emulsion and finer solids along the cross-flow filter to produce a retentate comprising brine and solids and a permeate comprising hydrocarbon, including oils and other hydrocarbons. The hydrocarbon emulsion and finer solids may be passed along a cross-flow filter to produce a retentate comprising brine and solids and a permeate comprising hydrocarbon in any of a variety of different ways. For example, the hydrocarbon emulsion may be passed along a cross-flow filter to produce a retentate comprising brine and solids and a permeate comprising hydrocarbon as described herein with respect to other aspects of the invention. For example, with reference to FIGS. 1 and 2, passing the hydrocarbon emulsion and finer solids from the working tank along the upstream side of a cross-flow filter may comprise passing the hydrocarbon emulsion into the housing 30 via inlet port 32*a* and along the upstream side of cross-flow filter 31, passing the permeate out of the housing 30 comprising the cross-flow filter 31 via outlet port 32*b* as shown, e.g., by arrow 34, and passing the retentate out of the housing 30 comprising the cross-flow filter 31 via outlet port 32*c* as shown, e.g., by arrow 40.

Recirculating the retentate to the cross-flow may further include directing the retentate from a retentate region on the feed side of the cross-flow filter to the working tank in any of a variety of different ways. For example, with reference to FIGS. 1 and 2, recirculating the retentate to the cross-flow filter via a working tank comprises directing the retentate from the housing 30 comprising the cross-flow filter to the working tank 37 via outlet port 32*c* and inlet port 38*c* and directing the retentate from the working tank 37 to the housing 30 comprising the cross-flow filter 31 via outlet port 38*b* and inlet port 32*a*.

In any embodiment of the invention, the methods may further comprise adding one or more of additional hydrocarbon, a demulsifier, a reverse demulsifier, a coagulant, and a flocculant to promote destabilization of the hydrocarbon emulsion, to facilitate at least partial decomposition of the emulsion and/or substances in the emulsion, and/or to facilitate separation of the substances from the emulsion. The type and amount of the additional hydrocarbon, demulsifier, reverse demulsifier, coagulant, and/or flocculant added to the emulsion may vary depending on a variety of factors, including, for example, one or more of temperature; pressure; pH; amount of shear; composition of the organic and inorganic solids; concentration of asphaltenes, well-treating chemicals, paraffins, or sulfur; API gravity of the crude oil; the difference in density between the brine and crude oil; and the composition and stability of the emulsion.

Any of a variety of hydrocarbons may be added to dissolve substances, including asphaltenes, that help to stabilize the emulsions and/or that foul the filter media. The additional hydrocarbon may also reduce the viscosity of the emulsion and/or establish an oil or hydrocarbon as the continuous phase of the emulsion. The added hydrocarbon, which may be aromatic or nonaromatic, may include, for example, one or more of reformate, naphtha, gas oil and hydrocarbon condensate. In some embodiments, hydrocarbon of up to about ten or more times the volume of the emulsion may be added. Where the amount of stabilizing agent, e.g., asphaltene, in the rag layer is small, less hydrocarbon may be added; for example, hydrocarbon in an amount of about one to about two times the volume of the emulsion. In some embodiments, hydrocarbon in the range from about 1% by weight or less to about 50% by weight or more may be added. In some embodiments no hydrocarbon may be added.

Further, any of a variety of demulsifiers and/or reverse demulsifiers may be added to at least partially break down the emulsion and facilitate separation of the substances in the emulsion. The added deemulsifers may include, for example, one or more of ethoxylated or propoxylated acid- or base-catalyzed phenol-formaldehyde resins, ethoxylated or propoxylated polyamines, ethoxylated or propoxylated di-epoxides, and ethoxylated or propoxylated polyols. The added reverse demulsifiers may include, for example, organic polymers, such as liquid cationic acrylamides. Any of numerous coagulants and/or flocculants may be added to aggregate and/or agglomerate solids in the emulsion, allowing the larger agglomerated solids to settle from the emulsion. The added coagulants may include liquid organic or inorganic coagulating polymers, including, for example, a liquid, organic, water-soluble, low cationic quaternary ammonium polyelectrolyte. The flocculant may include, for example, a liquid organic acrylic acid/acrylamide copolymer with a high molecular weight and/or a low-to-medium anionic charge. For many embodiments, the demulsifier, reverse demulsifier, coagulant, and/or flocculant may be added in an amount in the range from 0% to about 1% or more of the rag layer. In some embodiments, deemulsifers may be added to a concentration in the range from about 1 ppmw or less to about 200 ppmw or more. In some embodiments none of the additional hydrocarbon, demulsifiers, reverse demulsifiers, coagulants, and flocculants may be added.

One or more of additional hydrocarbon, demulsifiers, reverse demulsifiers, coagulants, and flocculants may be added to the rag layer in any of a variety of different ways. Methods may comprise adding only one or two or three and not others, or all may be added to the rag layer separately or in combination. In some embodiments, the one or more of additional hydrocarbon, demulsifier, reverse demulsifier, coagulant, or flocculant may be heated prior to, during, or after addition to the rag layer. The one or more of additional hydrocarbon, demulsifier, reverse demulsifier, coagulant, or flocculant may be heated to any of a variety of temperatures. For example, the hydrocarbon may be heated to a temperature of about 150° F. or less to about 300° F. or more. The temperature may be chosen based on a variety of factors including, for example, one or more of temperature, pressure, pH, amount of shear, concentration of asphaltenes, concentration of well-treating chemicals, concentration of paraffins, concentration of sulfur, API gravity of the crude oil, the difference in density between the brine and crude oil, and the stability of the emulsion. In some embodiments, the hydrocarbon and/or deemuslfiers are not heated.

The one or more of additional hydrocarbon, demulsifier, reverse demulsifier, coagulant, and flocculant may be added to the rag layer at any time during the method of processing crude oil. For example, the one or more of additional hydrocarbon, demulsifier, reverse demulsifier, coagulant, and flocculant may be added to the rag layer after adding water to the crude oil and before passing the hydrocarbon emulsion along the cross-flow filter or after separating oil from brine and before separating the rag layer into a hydrocarbon emulsion and brine comprising solids. In some embodiments, the one or more of additional hydrocarbon, demulsifier, reverse demulsifier, coagulant, and flocculant are added to the rag layer after separating brine from the brine comprising the rag layer and before separating the rag layer into a hydrocarbon emulsion with finer solids and brine comprising larger solids. For example, with reference to FIG. 1, the one or more of additional hydrocarbon, demulsifier, reverse demulsifier, coagulant, and flocculant may be added to the rag layer via common inlet port 16 as shown, e.g., from sources 17*a-e*, downstream from the desalter 2 or the bulk separator 12 and upstream of or within the separator 25.

In some embodiments of the invention, methods may further comprise mixing the hydrocarbon and/or deemulsifers in the rag layer. The one or more of additional hydrocarbon, demulsifier, reverse demulsifier, coagulant, and flocculant may be mixed in the rag layer in any of a variety of different ways. For example, the rag layer and the one or more of additional hydrocarbon, demulsifier, reverse demulsifier, coagulant, and flocculant may be mixed after adding the one or more of additional hydrocarbon, demulsifier, reverse demulsifier, coagulant, and flocculant and before separating the rag layer into the hydrocarbon emulsion having fine solids and brine comprising larger solids. With reference to FIG. 1, the one or more of additional hydrocarbon, demulsifier, reverse demulsifier, coagulant, and flocculant may be mixed in the rag layer in mixer 20. The method may comprise directing the rag layer and the one or more of additional hydrocarbon, demulsifier, reverse demulsifier, coagulant, and flocculant through the mixer 20 via inlet port 21*a* and directing the mixed, treated rag layer out of the mixer via outlet port 21*b*. Alternatively, the rag layer may be mixed with the one or more of additional hydrocarbon, demulsifier, reverse demulsifier, coagulant, and flocculant within the separator.

In all embodiments, methods may further comprise cleaning the filter media of the cross-flow filters. The filter media may be cleaned in a variety of different ways. For example, cleaning the filter media may comprise directing a cleaning fluid tangentially along the upstream side of the filter media and/or backwashing the filter media by directing a cleaning fluid from the downstream side to the upstream side, or vice versa, through the filter media, with or without a gas assist. Any of a variety of cleaning fluids may be used and the cleaning fluid may have one or more additives, including, for example, solvents and/or surfactants. The filter media may also be soaked, for example, in a hot hydrocarbon.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A method of processing crude oil comprising:

adding water to the crude oil to produce oil and brine and a rag layer including an emulsion comprising brine and oil and solids;

separating oil from brine including producing brine comprising the rag layer;

separating the rag layer into a hydrocarbon emulsion having finer solids and brine comprising larger solids; and passing the hydrocarbon emulsion and finer solids along a cross-flow filter to produce a retentate comprising brine and solids and a permeate comprising hydrocarbon.

2. The method according to claim 1, further comprising separating brine from the brine comprising the rag layer.

3. The method according to claim 2, wherein separating brine from the brine comprising the rag layer comprises passing the brine comprising the rag layer through a settling tank, gravity separator, or a coalescing plate interceptor (CPI) separator.

4. The method according to claim 1, further comprising adding one or more of additional hydrocarbon, a demulsifier, a reverse demulsifier, a coagulant, and a flocculant to the rag layer.

5. A method of processing crude oil comprising:

passing the crude oil through a desalter, including separating oil from brine comprising a rag layer and removing the brine comprising a rag layer from the desalter via a first port and removing the oil via a second port;

passing the brine comprising the rag layer through a separator including separating the rag layer into a hydrocarbon emulsion having finer solids and brine comprising larger solids, including removing the brine comprising larger solids from the separator via a third port and removing the hydrocarbon emulsion and finer solids from the separator via a fourth port; and filtering the hydrocarbon emulsion and finer solids using a cross-flow filter to produce a retentate comprising brine and solids and a permeate comprising hydrocarbon, including removing the retentate from the cross-flow filter via a fifth port and removing the permeate from the cross-flow filter via a sixth port.

6. The method according to claim 5, further comprising adding one or more of additional hydrocarbon, a demulsifier, a reverse demulsifier, a coagulant, and a flocculant to the rag layer.

7. The method according to claim 6, further comprising mixing the rag layer and the one or more of the additional hydrocarbon, the demulsifier, the reverse demulsifier, the coagulant, and the flocculant in a mixer.

8. The method according to claim 5, wherein separating the rag layer into a hydrocarbon emulsion having finer solids and brine comprising larger solids comprises passing the rag layer through a settling tank or a mixing tank.

9. The method according to claim 1, further comprising recirculating the retentate to the cross-flow filter.

10. The method according to claim 9, further comprising directing the hydrocarbon emulsion and finer solids from the separator to a working tank and recirculating the hydrocarbon emulsion to the cross-flow filter via the working tank.

* * * * *